US006003490A

United States Patent [19]

Kihara et al.

[11] Patent Number: 6,003,490

[45] Date of Patent: Dec. 21, 1999

[54] THROTTLE DEVICE HAVING AIR FLOW COMPENSATION FUNCTION

[75] Inventors: Noriyasu Kihara, Takahama; Noboru Kitahara; Makoto Kio, both of Kariya, all of Japan

[73] Assignee: Denso Corporation, Japan

[21] Appl. No.: 09/042,717

[22] Filed: Mar. 17, 1998

[30] Foreign Application Priority Data

Mar. 19, 1997 [JP] Japan ..... 9-066044

[51] Int. Cl.[6] ..... F02D 9/08

[52] U.S. Cl. ..... 123/337; 73/118.2; 123/494

[58] Field of Search ..... 123/336, 337, 123/442, 494; 73/118.2, 204.21; 251/305, 308; 261/65

[56] References Cited

U.S. PATENT DOCUMENTS

| | | | |
|---|---|---|---|
| 4,378,000 | 3/1983 | Moriya et al. | 123/442 |
| 4,547,325 | 10/1985 | Shivers, Jr. | 261/65 |
| 4,768,486 | 9/1988 | Koike et al. | 123/442 |
| 4,922,879 | 5/1990 | Kaji et al. | 123/494 |

FOREIGN PATENT DOCUMENTS

| | | |
|---|---|---|
| 48-041916 | 3/1973 | Japan . |
| 53-142617 | of 1978 | Japan . |
| 64-66462 | 3/1989 | Japan . |
| 1-85433 | 6/1989 | Japan . |
| 1-247723 | 10/1989 | Japan . |
| 8-338269 | 12/1996 | Japan . |

*Primary Examiner*—Tony M. Argenbright
*Attorney, Agent, or Firm*—Nixon & Vanderhye PC

[57] ABSTRACT

A throttle device comprises a throttle valve having a circular body and a compensation member made of resin. The body has an upstream half rotatable at an upstream side with respect to a throttle shaft and a downstream half rotatable at a downstream side with respect thereto. The compensation member is installed on the upstream half at a downstream side thereof and bulged toward an inner wall of a throttle body. When the throttle valve rotates in an open direction from a closed position, the area of an intake air passage at the upstream half is smaller than the area of a passage at the downstream half and thus, the difference between the flow velocity at the upstream half and that at the downstream half can be reduced. Accordingly, it is possible to restrict the flow of the intake air from becoming oblique to the axis of the intake air passage and hence measure the flow rate of the intake air accurately.

17 Claims, 7 Drawing Sheets

THROTTLE DEVICE HAVING AIR FLOW COMPENSATION FUNCTION

CROSS REFERENCE TO RELATED APPLICATION

This application relates to and incorporates herein by reference Japanese Patent Application No. 9-66044 filed on Mar. 19, 1997.

BACKGROUND OF THE INVENTION

1. Field of the Invention

The present invention relates to a throttle device for an internal combustion engine.

2. Description of Related Art

Throttle devices having a butterfly-type throttle valve are known as disclosed in Laid-Open Japanese Utility Model Publications Nos. 48-41916, 53-142617, and 1-85433. Those devices are intended to adjust the flow rate of intake air flowing in the intake air passage by altering the shape of the throttle valve according to a degree of opening of the butterfly-type throttle valve. The flow rate of the intake air flowing into the throttle device is measured by an air flow meter.

In recent years, the size of air intake systems has been reduced by mounting an air flow meter proximate to the throttle valve. However, upstream from and proximate to the throttle valve, the flow velocity of the intake air flowing at the upstream half side of the throttle valve is higher than that of the intake air flowing at the downstream half side thereof. That is, the flow velocity of the intake air is different according to the position in a section of the intake air passage. Therefore, it is difficult for an air flow meter positioned proximate to and upstream from the throttle valve to measure the flow rate of the intake air with high accuracy. Further, when the intake air collides with the throttle valve, the air flow becomes turbulent in the periphery of the upstream half of the throttle valve, thus generating an eddy flow. Thus, it is difficult to measure the flow rate of the intake air with high accuracy.

The above throttle devices are intended not to measure the flow rate of the intake air with high accuracy but to adjust the flow rate of the intake air by altering the shape of the throttle valve.

It is possible to restrict a throttle valve-caused fluctuation in the flow velocity of the intake air and the generation of a turbulent flow, by installing the air flow meter at a position upstream and distant from the throttle valve. However, such a construction causes the throttle device to be long and large.

SUMMARY OF THE INVENTION

It is an object of the present invention to provide a throttle device allowing the flow rate of intake air to be measured with high accuracy at a upstream side in the flow of the intake air.

It is another object of the present invention to provide a throttle device having an air flow meter integrally in a compact size.

According to a throttle device of the present invention, the area of an intake air passage at the upstream half of a throttle valve is made smaller than the area of the intake air passage at a downstream half thereof so that the resistance of the intake air passage at the upstream half side is greater than that at the downstream half side. Thus, the flow velocity of the intake air at the upstream half side is reduced.

Accordingly, it is possible to reduce the difference between the flow velocity at the upstream half side and that at the downstream half side, which makes it possible to allow the flow velocity of the intake air to be uniform in a section of the intake air passage in a region upstream from and proximate to the throttle valve.

Preferably, the downstream-side surface of the upstream half of the throttle valve is bulged toward the inner wall of the throttle body, which allows the area of the intake air passage formed between the upstream half and the inner wall to be smaller than that of the intake air passage of the throttle valve having no bulged portion. Consequently, the area of the intake air passage at the upstream half side is smaller than the area of the intake air passage at the downstream half side, which reduces the difference between the flow velocity at the upstream half side and that at the downstream half side.

Preferably, the rotation shaft of the throttle valve is dislocated toward the upstream half so that the movement distance of the peripheral edge of the upstream half is shorter than the movement distance of the peripheral edge of the downstream half, and the area increase/decrease percentage of the intake air passage at the upstream half side is smaller than that of the intake air passage at the downstream half side. Thus, the difference between the flow velocity at the upstream half side and that at the downstream half side can be reduced.

Preferably, an enlarged portion is formed on an inner wall of the throttle body at the downstream half side to allow the area of the intake air passage at the downstream half side to be larger than the area of the intake air passage at the upstream half side so that the difference between the flow velocity at the upstream half side and that at the downstream half side can be reduced.

Preferably, a projection directed toward the upstream side of the flow of the intake air is formed on a peripheral edge of the upstream-side surface of the upstream half of the throttle valve to flow the intake air current which collides with the throttle valve into an air current flowing in the upstream half side and an air current flowing in the downstream half side. Thus, the intake air can be restricted from generating an eddy flow in the region upstream from and proximately to the throttle valve.

More preferably, the projection has a gradually changing surface with respect to the flow of the intake air to restrict a turbulent air flow from being generated when the projection divides the flow of the intake air into the two. Still more preferably, the projection has an inclined surface directed toward a peripheral edge of the upstream half and an inclined surface directed toward a peripheral edge of the downstream half to flow the intake air dividedly toward the upstream half side and the downstream half side along each inclined surface.

An air flow meter for measuring the flow rate of the intake air is installed at a position, upstream from and proximate to the throttle valve, where the air flow meter does not interfere with the throttle valve when it rotates. More preferably, the air flow meter is positioned in a plane perpendicular to the axis of the intake air passage and dislocated toward the upstream half.

BRIEF DESCRIPTION OF THE DRAWINGS

Other objects, features and advantages of the present invention will become more apparent from the following detailed description when read with reference to the accompanying drawings. In the drawings.

DETAILED DESCRIPTION OF THE PREFERRED EMBODIMENTS

Various embodiments of the present invention will be described in detail with reference to the drawings, throughout which the same numerals denote the same or like parts.

(First Embodiment)

Figure 1:
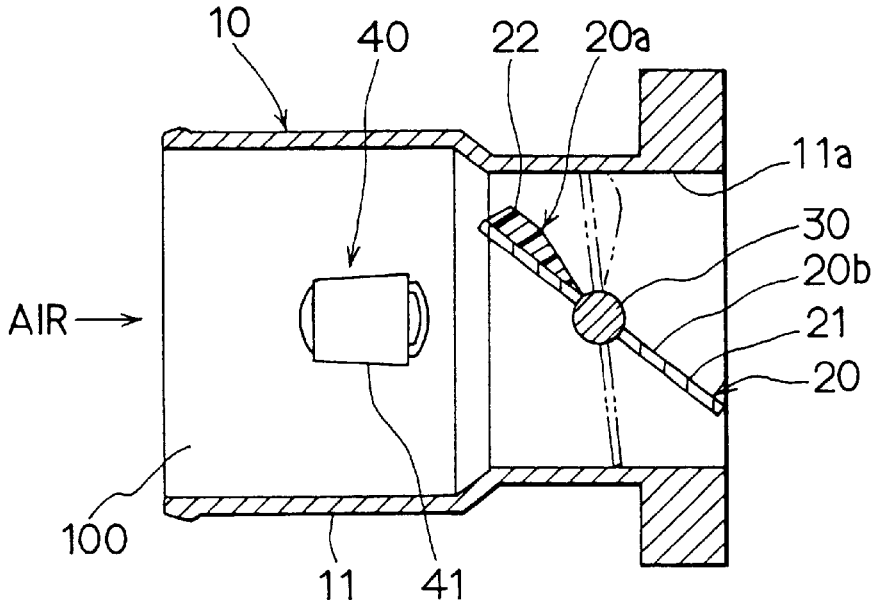
FIG. 1 is a sectional view showing a throttle device according to a first embodiment of the present invention.

A throttle device 10 according to the first embodiment shown in FIG. 1 has a throttle valve 20 installed on a throttle shaft 30 serving as the rotation shaft thereof for adjusting the flow rate of intake air flowing in a generally cylindrical intake air passage 100 according to a degree of opening of the throttle valve 20. The throttle shaft 30 is rotatably supported by a generally cylindrical throttle body 11. An intake port 41 of an air flow meter 40 serving as a device for measuring the flow rate of the intake air is installed at a position, upstream from and proximate to the throttle valve 20, where the air flow meter 40 does not interfere with the throttle valve 20 when the throttle valve 20 rotates.

Figure 2:
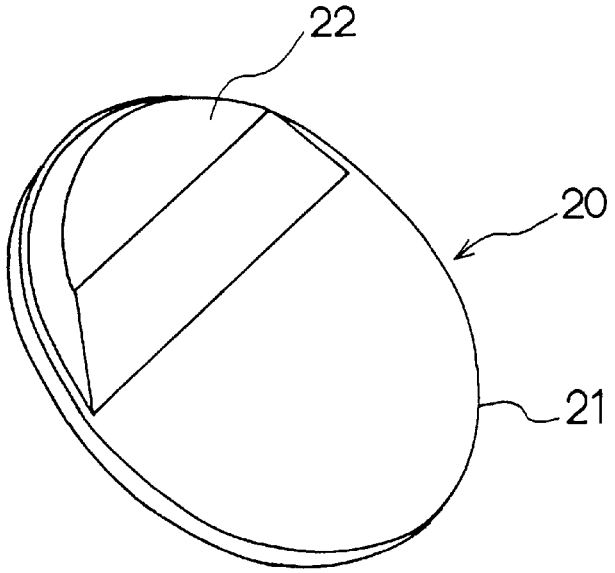
FIG. 2 is a perspective view showing the throttle valve according to the first embodiment.

The throttle valve 20 comprises a circular or disk-like valve body 21 and a semi-circular compensation member 22 made of a resinous material. The valve body 21 comprises an upstream half 20*a* rotatable toward the upstream side with respect to the throttle shaft 30 and a downstream half 20*b* rotatable toward the downstream side with respect to the throttle shaft 30 provided centrally in the air passage 100. As shown in FIG. 2, the compensation member 22 is attached to the upstream half 20*a* at the downstream side. As shown in FIG. 1, a part of the compensation member 22 proximate to the outer periphery of the upstream half 20*a* is thicker than a part thereof proximate to the throttle shaft 30, thus bulging toward an inner wall 11*a* of the throttle body 11 forming the intake air passage 100. The periphery of the compensation member 22 is positioned a little inward from the periphery of the valve body 21 to restrict the thickened periphery of the compensation member 22 from contacting the inner wall 11*a* when the throttle valve 20 rotates.

Figure 3:
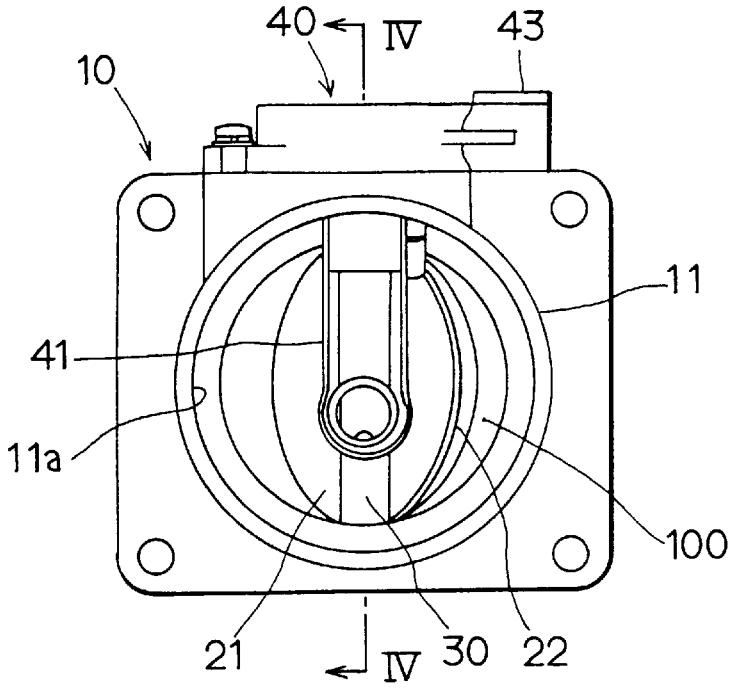
FIG. 3 is a front plan view of the throttle device according to the first embodiment.
Figure 4:
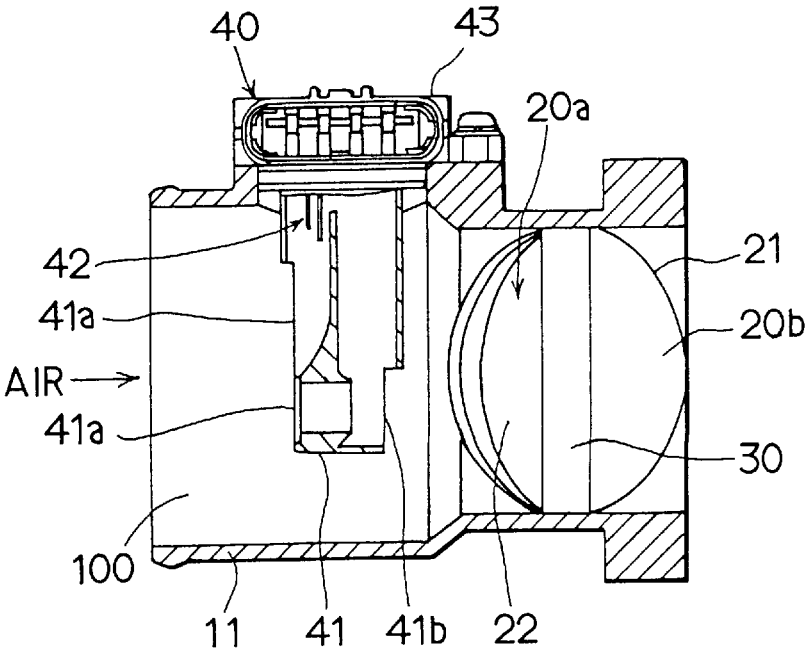
FIG. 4 is a sectional view taken along a line IV—IV in FIG. 3.

As shown in FIGS. 3 and 4, the intake port 41 of the air flow meter 40 having an entrance 41*a* and an exit 41*b* formed thereon is positioned in an imaginary plane which includes the throttle shaft 30 and which is parallel with the longitudinal axis of the intake air passage 100. Intake air which flows into the intake port 41 from the entrance 41*a* passes through a U-shaped bypass passage and a Venturi passage, thus being confluent with one another at the exit 41*b* and flowing downstream. A sensor 42 which is known well in the art is installed inside the intake port 41. A signal indicating a flow rate of the intake air detected by the sensor 42 is transmitted to an engine control device through a connector 43.

Figure 5:
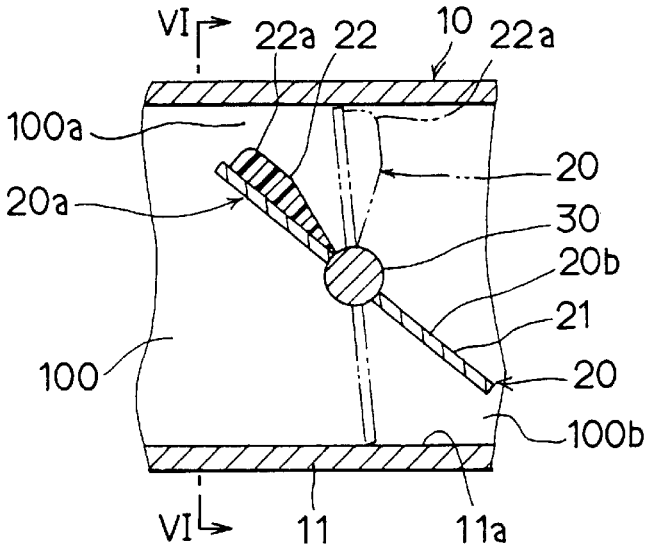
FIG. 5 is a sectional view showing a part of the throttle device according to the first embodiment.
Figure 6:
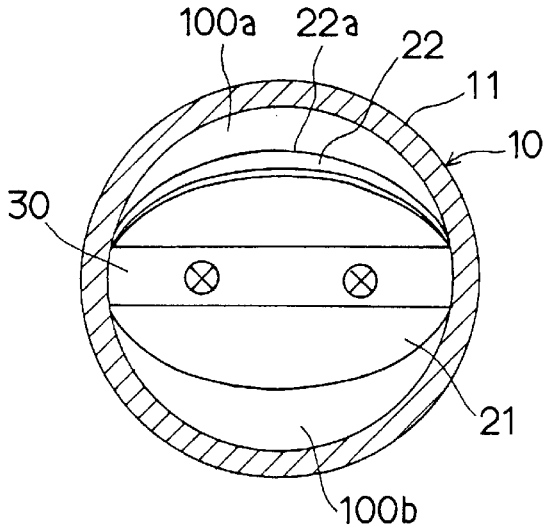
FIG. 6 is a sectional view taken along a line VI—VI in FIG. 5.

In the above throttle device 10, the throttle valve 20 is held at a position shown by a two-dot chain line in FIG. 5 when it is completely closed. When the throttle valve 20 rotates in the open direction from the closed position, the distance between the bulged portion 22*a* of the compensation member 22 installed on the upstream half 20*a* and the inner wall 11*a* becomes shorter than the distance between the downstream half 20*b* and the inner wall 11*a*. That is, the area of a passage 100*a* formed between the upstream half 20*a* and the inner wall 11*a* is smaller than that of a passage 100*b* formed between the downstream half 20*b* and the inner wall 11*a*. Thus, the air flow resistance in the passage 100*a* is greater than that of the passage 100*b*.

Without the compensation member 22, the area of the passage 100*a* formed between the upstream half 20*a* and inner wall 11*a* is almost equal to that of the passage 100*b* formed between the downstream half 20*b* and the inner wall 11*a*. In this case, the flow velocity of the intake air flowing upstream from and proximately to the throttle valve 20 is faster at the upstream half side than the flow velocity thereof at the downstream half side. As a result, the flow velocity of the intake air is nonuniform in a section of the intake air passage 100.

In the first embodiment, however, the passage resistance at the upstream half 20*a* is greater than that at the downstream half 20*b*, because the compensation member 22 is provided on the upstream half 20*a* at its downstream surface. Thus, in the region upstream from and proximately to the throttle valve 20, it is possible to reduce the difference between the flow velocity at the upstream half side and that at the downstream half side. Accordingly, it is possible to equalize the flow velocity of the intake air to be uniform throughout a section of the intake air passage 100 and restrict the generation of air flows oblique to the axis of the intake air passage 100. Consequently, the measured flow rate of the intake air flowing in the region upstream from and proximately to the throttle valve is almost equal to that measured before the flow velocity of the intake air becomes nonuniform as a result of the collision thereof with the throttle valve 20.

(Second Embodiment)

Figure 7:
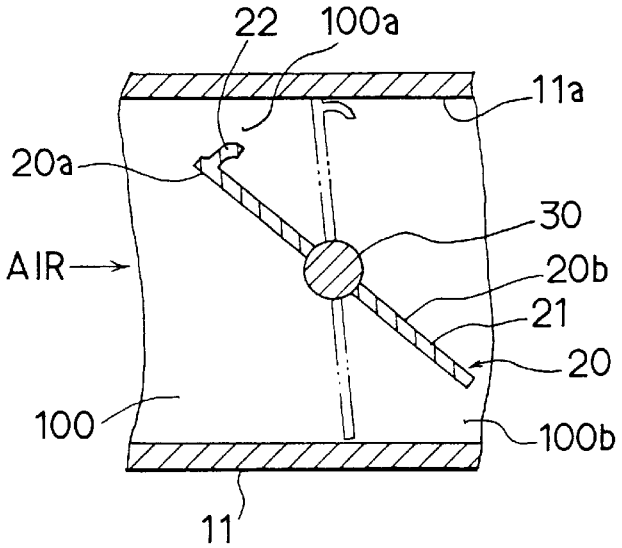
FIG. 7 is a sectional view showing a part of the throttle device according to a second embodiment.

In the second embodiment shown in FIG. 7, a valve body 21 is deformed at a position slightly inward from the periphery of an upstream half 20*a* of the throttle valve 20 to form a semi-circular arc-shaped edge as the compensation member bulging toward the inner wall 11*a*.

When the throttle valve 20 rotates in the open direction from the closed position, the distance between the edge 22 and the inner wall 11*a* is shorter than the distance between the a downstream half 20*b* and the inner wall 11*a*. That is, the area of a passage 100*a* formed between the upstream half 20*a* and the inner wall 11*a* is smaller than that of the passage 100*b* formed between the downstream half 20*b* and the inner wall 11*a*. Thus, in the region upstream from and proximately to the throttle valve 20, it is possible to reduce the difference between the flow velocity at the upstream half 20*a* and that at the downstream half 20*b*. Accordingly, it is possible to allow the flow velocity of the intake air to be uniform throughout the intake air passage 100 and restrict the generation of air flows oblique to the axis of the intake air passage 100. Consequently, it is possible to accurately measure the flow rate of the intake air flowing in the region upstream from and proximately to the throttle valve 20.

(Third Embodiment)

Figure 8:
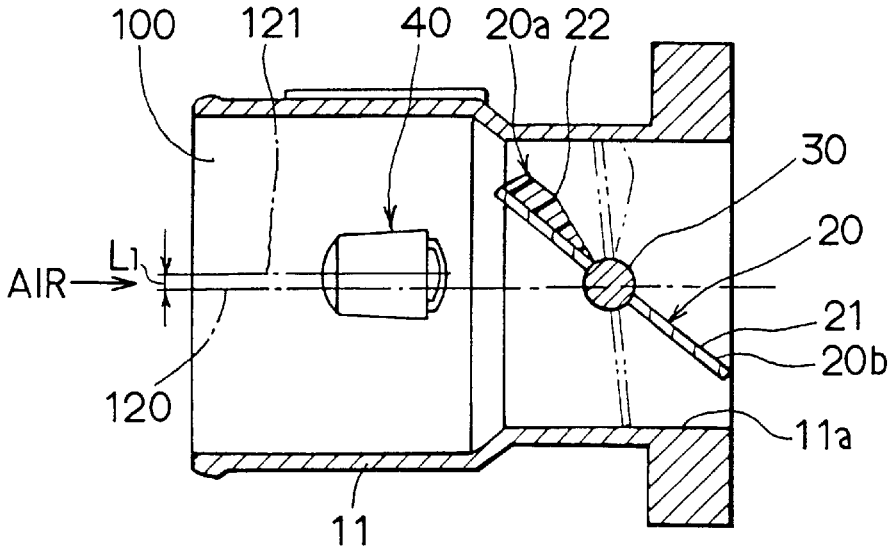
FIG. 8 is a sectional view showing the throttle device according to a third embodiment.
Figure 9:
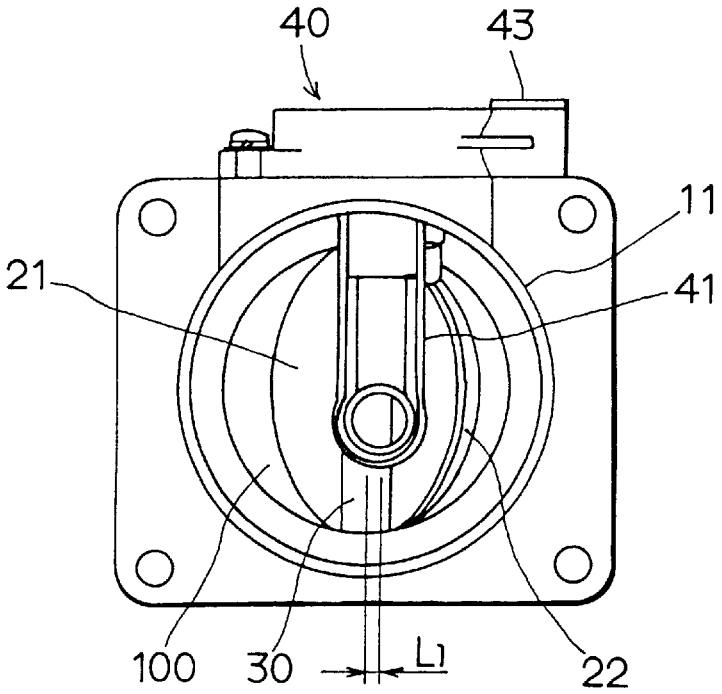
FIG. 9 is a front plan view of the throttle device according to the third embodiment.

In the third embodiment shown in FIGS. 8 and 9, the intake port 41 of an air flow meter 40 is dislocated from the axis 120 of the intake air passage 100 toward the upstream half 20*a* in parallel with the axis 120. The axis 121 of the air flow meter 40 is dislocated by a distance L1 from the axis 120 toward the upstream half 20*a*.

In the region upstream from and proximately to the throttle valve 20, the compensation member 22 allows the difference between the flow velocity at the upstream half 20*a* and that at the downstream half 20*b* to be small. When the intake air collides with the throttle valve 20, the velocity of the intake air flowing along the axis 120 becomes slower than the flow velocity thereof at the time before the intake air becomes turbulent. Only the flow velocity of the intake air flowing along the axis 121 of the air flow meter 40 dislocated from the axis 120 of the intake air passage 100 toward the upstream half 20*a* is almost equal to the flow velocity at the time before the flow velocity thereof becomes nonuniform as a result of the collision between the intake air and the throttle valve 20.

In this embodiment, the flow rate of the intake air can be accurately measured by dislocating the air flow meter 40 from the axis 120 of the intake air passage 100 toward the upstream half 20*a*.

Although both the entrance and exit of the intake port of the air flow meter 40 are dislocated toward the upstream half 20*a* in this embodiment, it is possible to measure the flow rate of the intake air accurately by dislocating the entrance or the exit of the intake port of the air flow meter 40 toward the upstream half 20*a*.

(Fourth Embodiment)

Figure 10:
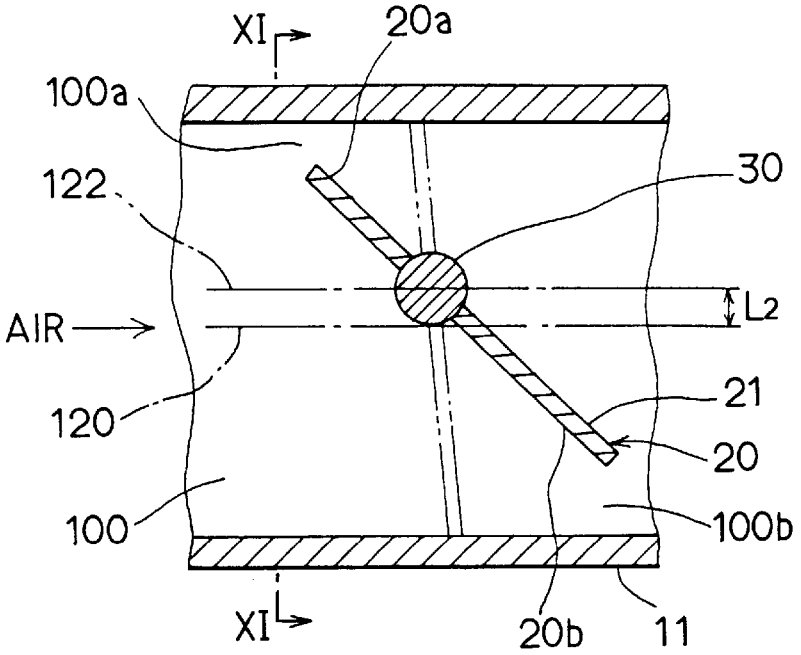
FIG. 10 is a sectional view showing a part of the throttle device according to a fourth embodiment.
Figure 11:
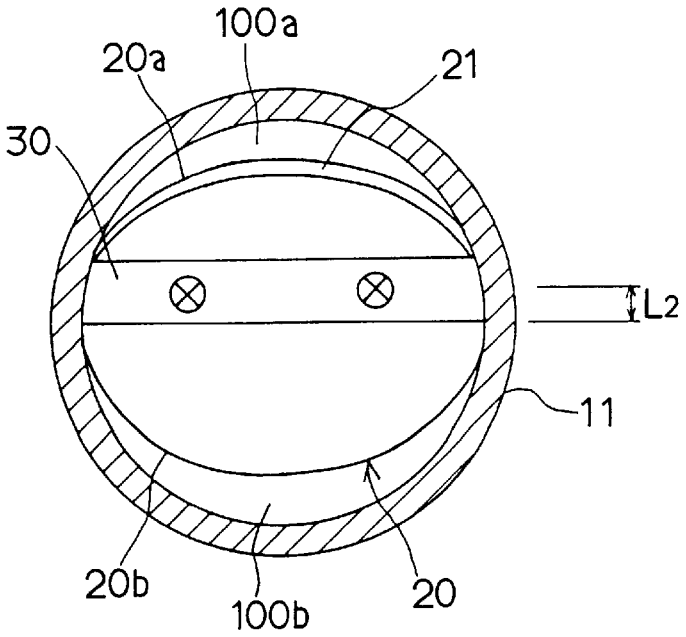
FIG. 11 is a sectional view taken along a line XI—XI in FIG. 10.

In the fourth embodiment shown in FIGS. 10 and 11, the valve body 21 of the throttle valve 20 is installed on the throttle shaft 30 not diametrically, namely, not on the axis 120 of the intake air passage 100, but installed on the throttle shaft 30 dislocated a certain distance in parallel with the axis 120 of the intake air passage 100 toward an upstream half 20*a*. An imaginary line 122 parallel with the axis 120 and passing through the throttle shaft 30 is spaced at a distance L2 from the axis 120 of the air passage 100.

When the throttle valve 20 rotates in the open direction from the closed position, the movement distance of the peripheral edge of the upstream half 20*a* becomes shorter than the movement distance of the peripheral edge of the downstream half 20*b*, and the area increase/decrease percentage of the passage 100*a* becomes smaller than that of the passage 100*b*. That is, the area of the passage 100*a* at the upstream half side becomes smaller than that of the passage 100*b* at the downstream half side. Thus, in the region upstream from and proximately to the throttle valve 20, it is possible to reduce the difference between the flow velocity at the upstream half side and that at the downstream half side. Accordingly, it is possible to allow the flow velocity of the intake air to be uniform throughout the section of the intake air passage 100 and restrict the generation of air flows oblique to the axis of the intake air passage 100.

In this embodiment, the flow rate of the intake air can be accurately measured without increasing the number of parts of the throttle device by installing the valve body 21 on the throttle shaft 30 not diametrically, but by dislocating the throttle shaft 30 toward the upstream half 20*a*.

(Fifth Embodiment)

Figure 12:
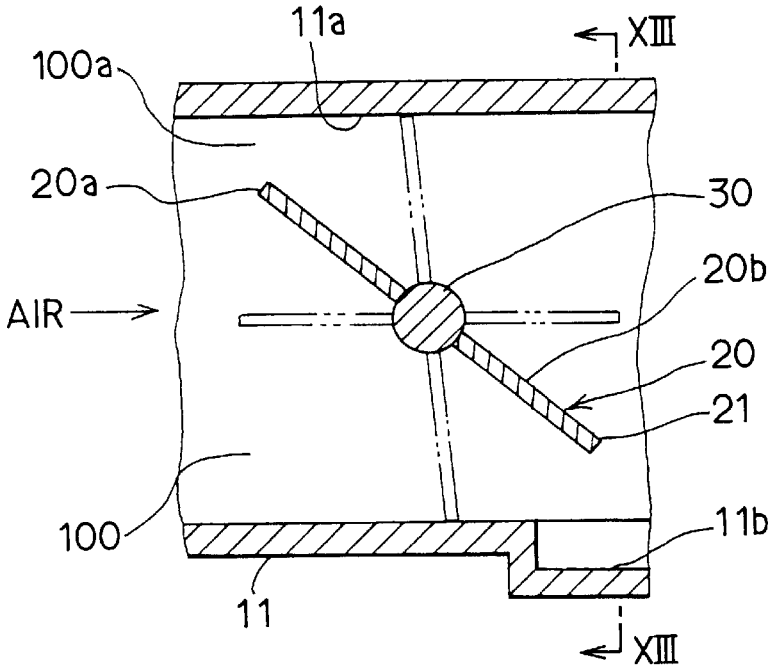
FIG. 12 is a sectional view showing a part of the throttle device according to a fifth embodiment.
Figure 13:
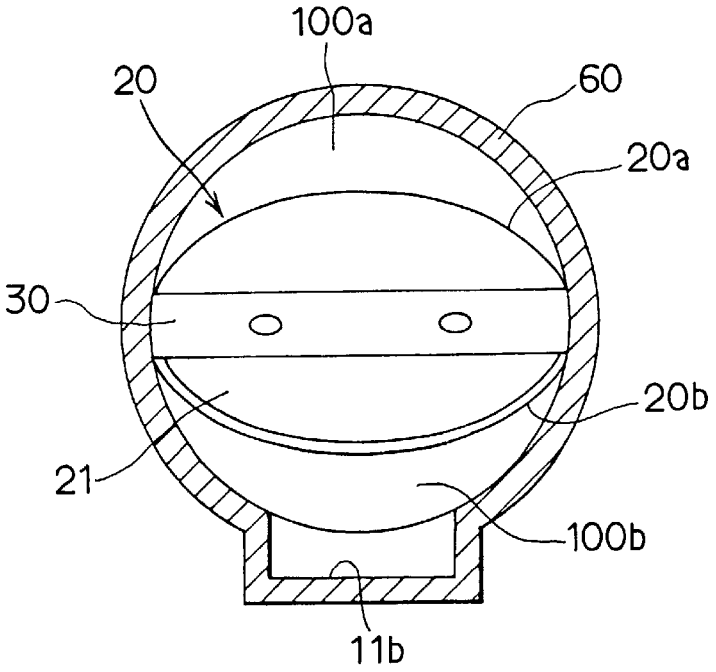
FIG. 13 is a sectional view taken along a line XIII—XIII in FIG. 12.

In the fifth embodiment shown in FIGS. 12 and 13, the valve body 21 of this throttle valve 20 is installed on the throttle shaft 30 diametrically. As an enlarged portion of an intake air passage 100, a concave 11*b* is formed on the cylindrical inner wall 11*a* of the throttle body 11 forming the intake air passage 100 such that the concave 11*b* is located at the downstream half side. In order to close the intake air passage 100 when the throttle valve 20 is completely closed, the upstream end of the concave 11*b* is positioned downstream from the position at which the downstream half 20*b* is located when the throttle valve 20 is completely closed.

When the throttle valve 20 rotates in the open direction from the closed position, the area of the passage 100*b* formed between the downstream half 20*b* and the concave 11*b* is greater than the area of a passage 100*a* formed between the upstream half 20*a* and the inner wall 11*a*. Thus, in the region upstream from and proximately to the throttle valve 20, the difference between the flow velocity at the upstream half side and that at the downstream half side can be reduced. Accordingly, it is possible to allow the flow velocity of the intake air to be uniform in a section of the intake air passage 100 and restrict the generation of air flows oblique to the axis of the intake air passage 100.

In this embodiment, the flow rate of the intake air can be accurately measured without increasing the number of parts by forming the concave 11*b* on the inner wall 11*a* at the downstream half side thereof.

(Sixth Embodiment)

Figure 14:
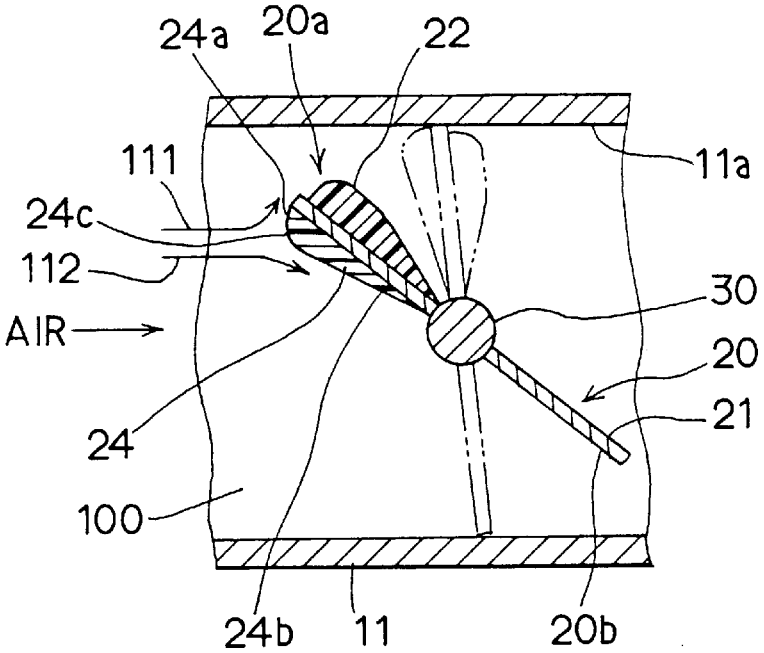
FIG. 14 is a sectional view showing a part of the throttle device according to a sixth embodiment.

In the sixth embodiment shown in FIG. 14, in addition to the compensation member 22 of the first embodiment, a resinous semi-circular air flow-dividing member 24 is installed on the upstream half 20*a* of the throttle valve 20. The air flow-dividing member 24 has an inclined surface 24*a* curved toward the peripheral edge of the upstream half 20*a* and an inclined surface 24*b* curved toward the peripheral edge of the downstream half 20*b*. A boundary surface 24*c* of the air flow-dividing member 24 positioned between the inclined surface 24*a* and the inclined surface 24*b* is also positioned at the peripheral edge of the upstream half 20*a* at the upstream side thereof, thus projecting in the upstream side of the flow of the intake air. The inclined surface 24*a* and the inclined surface 24*b* are curved smoothly.

The intake air current flowing toward the throttle valve 20 is guided by the inclined surfaces 24*a* and 24*b*, thus flowing at the upstream half side and the downstream half side, as shown by arrows 111 and 112 without generating an eddy flow.

Accordingly, the compensation member 22 reduces the difference between the flow velocity at the upstream half side and that at the downstream half side. Further, the air flow-dividing member 24 divides the intake air flow into the two currents without making it turbulent in the periphery of the upstream half 20*a*. Thus, it is possible to accurately measure the flow rate of the intake air flowing in the region upstream from and proximately to the throttle valve 20.

Although the inclined surface 24*a* and the inclined surface 24*b* are constituted of a gradually curved surface, respectively, it is possible to install air flow-dividing members, for example, a member triangular in section on the peripheral edge of the upstream side of the upstream half 20*a*, provided that it is capable of directing the intake air flow toward the upstream half 20*a* and the downstream half 20*b* without causing it to be turbulent in the periphery of the upstream half 20*a* in particular.

(Seventh Embodiment)

Figure 15:
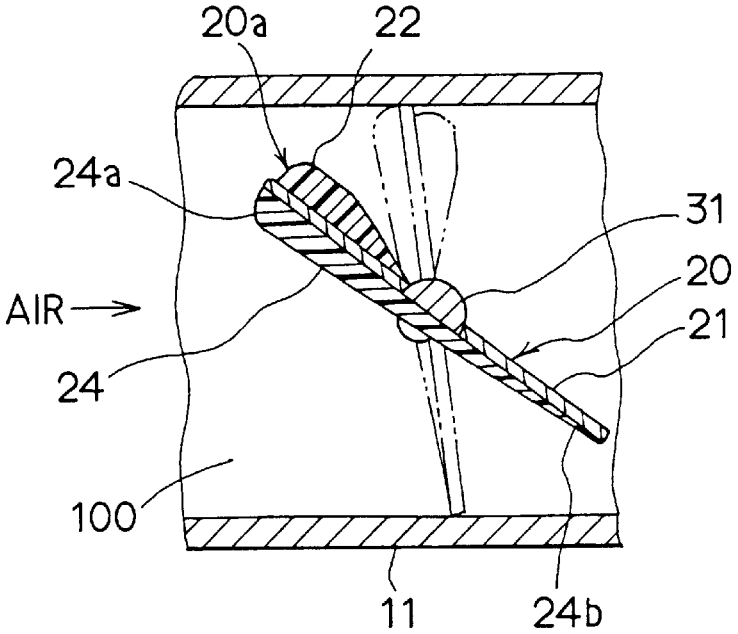
FIG. 15 is a sectional view showing a part of the throttle device according to a seventh embodiment.

In the seventh embodiment shown in FIG. 15, the air flow-dividing member 24 is attached to the valve body 21 of the throttle valve 20 such that the air flow-dividing member 24 covers its entire upstream side of the valve body 21. The projected portion 24*a* of the air flow-dividing member 24 constituted of the gradually changing curved surface is positioned on the peripheral edge of the upstream side of the upstream half 20*a*. A throttle shaft 31 on which the air flow-dividing member 24 is installed is cut away.

Similarly to the sixth embodiment, the compensation member 22 reduces the difference between the flow velocity at the upstream half side and that at the downstream half side. Further, the air flow-dividing member 24 divides the flow of the intake air flow into two without causing it to be turbulent. Thus, it is possible to accurately measure the flow rate of the intake air flowing in the region upstream from and proximately to the throttle valve 20.

Although the compensation member 22 is installed on the throttle valve 20 to reduce the flow velocity of the intake air at the upstream half side and the flow velocity thereof at the downstream half side in the above embodiments, it is also possible to control the flow rate of the intake air passing through the throttle valve 20 to obtain a desired characteristic by adjusting the installation position and shape of the compensation member 22.

Further, the compensation member 22 and the air flow-dividing member 24 may be made of metal. In addition, those members 22 and 24 may be separate from the valve body 21.

It is desirable that the shape of the throttle valve 20 of each embodiment is designed to restrict measured values from fluctuating over the entire range of the degree of opening of the throttle valve. However, it is possible to design the shape of the throttle valve 20 to restrict the measured values from fluctuating in a range, of the degree of opening of the throttle valve, which is mostly frequently used or in a flow rate range required to have maximum measurement accuracy.

In the throttle device of the embodiments, it is possible to constitute the throttle device 10 comprising the throttle body 11 provided with the throttle valve 20 and the air flow meter 40 fixed to each other and a cylindrical member serving as a duct connected with the throttle body 11.

The present invention should not be limited to the disclosed embodiments and modifications but may be modified or altered further without departing from the spirit of the invention.

We claim:

1. A throttle device comprising:

a throttle body forming an intake air passage therein;

a throttle valve rotatably supported by the throttle body in the intake air passage for adjusting a flow rate of intake air flowing in the intake air passage, the throttle valve having an upstream half rotatable toward an upstream side of a flow of the intake air when the intake air passage is opened and a downstream half rotatable toward a downstream side of the flow of the intake air when the intake air passage is opened; and an air flow meter positioned upstream from and proximate to the throttle valve in the throttle body, the air flow meter being positioned in a plane perpendicular to an axis of the intake air passage and dislocated toward the upstream half of the throttle valve, wherein an upstream side air flow area between the upstream half and the throttle body is smaller than a downstream side air flow area between the downstream half and the throttle body.

2. The throttle device according to claim 1, further comprising:

compensation means provided on one of the throttle body and the throttle valve for allowing the upstream side air flow area to be smaller than the downstream side air flow area.

3. The throttle device according to claim 2, wherein:

the compensation means includes a bulge provided on a downstream-side surface of the upstream half toward an inner wall of the throttle body forming the intake air passage.

4. The throttle device according to claim 2, wherein:

the compensation means includes a rotation shaft supporting the throttle valve thereon and dislocated toward the upstream half.

5. The throttle device according to claim 2, wherein said compensation means comprises a semi-circular arc shaped edge defined at a position slightly inwardly from a periphery of the upstream half and projecting from the downstream surface thereof whereby when the throttle valve rotates in an open direction, a distance between the semi-circular arc shaped edge and the throttle body is shorter than a distance between the downstream half and the throttle body.

6. The throttle device according to claim 1, wherein an inlet of the air flow meter is positioned in a plane perpendicular to the axis of the intake air passage and dislocated toward the upstream half.

7. A throttle device comprising:

a throttle body forming an intake air passage therein;

a throttle valve rotatably supported by the throttle body in the intake air passage for adjusting a flow rate of intake air flowing in the intake air passage, the throttle valve having an upstream half rotatable toward an upstream side of a flow of the intake air when the intake air passage is opened and a downstream half rotatable toward a downstream side of the flow of the intake air when the intake air passage is opened; and compensation means provided on one of the throttle body and the throttle valve for allowing the upstream side air flow area to be smaller than the downstream side air flow area, wherein an upstream side air flow area between the upstream half and the throttle body is smaller than a downstream side air flow area between the downstream half and the throttle body, and wherein the compensation means includes of an enlarged portion formed on an inner wall of the throttle body positioned at the side of the downstream half to allow the downstream side air flow area to be larger than the upstream side air flow area.

8. A throttle device comprising:

a throttle body forming an intake air passage therein;

a throttle valve rotatable supported by the throttle body in the intake air passage for adjusting a flow rate of intake air flowing in the intake air passage, the throttle valve having an upstream half rotatable toward an upstream side of a flow of the intake air when the intake air passage is opened and a downstream half rotatable toward a downstream side of the flow of the intake air when the intake air passage is opened; and a projection directed toward the upstream side in the flow of the intake air and formed on a peripheral edge of an upstream-side of the upstream half, wherein an upstream side air flow area between the upstream half and the throttle body is smaller than a downstream side air flow area between the downstream half and the throttle body.

9. The throttle device according to claim 8, wherein:

the projection has a gradually changing surface with respect to a flow of the intake air.

10. The throttle device according to claim 5, wherein:

the projection has an inclined surface directed toward a peripheral edge of the upstream half and an inclined surface directed toward a peripheral edge of the downstream half.

11. A throttle device comprising:

a throttle body forming a cylindrical intake air passage therein;

a throttle shaft rotatably supported by the throttle body and crossing transversely through a center of the intake air passage;

a throttle valve shaped in a disk and fixed to the throttle shaft in the intake air passage, the throttle valve having an upstream half from the throttle shaft and a downstream half from the throttle shaft which are rotatable toward an upstream side and a downstream side of an air flow in the intake air passage when the intake air passage is opened respectively;

a compensation member fixed to a downstream side of the upstream half of the throttle valve and having a thickest part near an outer periphery of the throttle valve to reduce an upstream side air flow area between the upstream half and the throttle body to be smaller than a downstream side air flow area between the downstream half and the throttle body when the throttle valve rotates to open the intake air passage; and an air flow meter located upstream of the throttle valve and dislocated toward the upstream half of the throttle valve from a longitudinal central axis of the intake air passage.

12. A throttle device according to claim 11, wherein said compensation means comprises a semi-circular arc shaped edge defined at a position slightly inwardly from a periphery of the upstream half and projecting from the downstream surface thereof whereby when the throttle valve rotates to open the intake air passage, a distance between the semi-circular arc shaped edge and the throttle body is shorter than a distance between the downstream half and the throttle body.

13. The throttle device comprising:

a throttle body forming a cylindrical intake air passage therein;

a throttle shaft rotatable supported by the throttle body and crossing transversely through a center of the intake air passage;

a throttle valve shaped in a disk and fixed to the throttle shaft in the intake air passage, the throttle valve having an upstream half from the throttle shaft and a downstream half from the throttle shaft which are rotatable toward an upstream side and a downstream side of an air flow in the intake air passage when the intake air passage is opened respectively;

a compensation member fixed to a downstream side of the upstream half of the throttle valve and having a thickest part near an outer periphery of the throttle valve to reduce an upstream side air flow area between the upstream half and the throttle body to be smaller than a downstream side air flow area between the downstream half and the throttle body when the throttle valve rotates to open the intake air passage; and a flow dividing member attached to an upstream side of the throttle valve and having a gradually changing surface including a thickest part near the outer periphery of the upstream half of the throttle valve, the thickest part being for diving an intake air toward the outer periphery of the upstream half of the throttle valve and toward the downstream half of the throttle valve.

14. A throttle device comprising:

a throttle body forming a cylindrical intake passage therein;

a throttle valve shaped in a disk and disposed in the intake air passage, the throttle valve having an upstream half and a downstream half which are rotatable toward an upstream side and a downstream side for an air flow in the intake passage when the intake air passage is opened respectively;

a throttle shaft fixed to the throttle valve and rotatably supported by the throttle body, the throttle shaft crossing transversely through the throttle valve and being dislocated from a longitudinal central axis of the intake air passage to reduce an upstream side air flow area between the upstream half and the throttle body to be smaller than a downstream side air flow area between the downstream half and the throttle body when the throttle valve rotates to open the intake air passage; and an air flow meter located upstream of the throttle valve and dislocated toward the upstream half of the throttle valve from a longitudinal central axis of the intake air passage.

15. A throttle device comprising:

a throttle shaft;

a throttle valve shaped in a disk and fixed to the throttle shaft, the throttle valve having an upstream half and a downstream half extending from the throttle shaft; and which are rotatable toward an upstream side and a downstream side of an air flow in the intake passage when the intake air passage is opened respectively; and a throttle body forming a cylindrical intake air passage therein and supporting rotatably the throttle shaft in the intake air passage, the throttle body having an enlarged part near an outer periphery of the downstream half of the throttle valve to increase a downstream side air flow area between the downstream half and the throttle body to be larger than an upstream side air flow area between the upstream half and the throttle body when the throttle valve rotates to open the intake air passage.

16. The throttle device according to claim 15, wherein:

the enlarged part is provided at a downstream side of a location where the downstream half of the throttle valve is located at a full closure of the intake air passage.

17. A throttle device according to claim 15, wherein an air flow meter is located upstream of the throttle valve and dislocated toward the upstream half of the throttle valve from a longitudinal central axis of the intake air passage.

* * * * *